US005508880A

United States Patent [19]

Beyer

[11] Patent Number: 5,508,880

[45] Date of Patent: Apr. 16, 1996

[54] AIR IONIZING RING

[75] Inventor: Douglas H. Beyer, Cathedral City, Calif.

[73] Assignee: Richmond Technology, Inc., Redlands, Calif.

[21] Appl. No.: 381,115

[22] Filed: Jan. 31, 1995

[51] Int. Cl.[6] ..... H05F 3/06

[52] U.S. Cl. ..... 361/230; 361/213

[58] Field of Search ..... 361/213, 225, 361/229, 230, 231, 212; 250/423 R, 324–326

[56] References Cited

U.S. PATENT DOCUMENTS

| | | | |
|---|---|---|---|
| 3,638,058 | 1/1972 | Fritzius | 361/230 X |
| 3,717,148 | 2/1973 | Svab | 361/230 X |
| 3,725,736 | 4/1973 | Bishop | 361/230 |
| 3,793,558 | 2/1974 | Lindsay | 361/213 |
| 4,496,375 | 1/1985 | Le Vantine | 96/66 |
| 4,768,126 | 8/1988 | Le Vantine | 361/213 |
| 4,974,115 | 11/1990 | Breidegam et al. | 361/231 |
| 5,150,273 | 9/1992 | Le Vantine | 361/221 |

*Primary Examiner*—Fritz M. Fleming
*Attorney, Agent, or Firm*—Stetina Brunda & Buyan

[57] ABSTRACT

An air ionizing ring that provides a flow of ionized gas, comprising a housing having an inlet side and an inlet opening, and a cap that releasably attaches to the inlet side of the housing. When a supply of pressurized gas comes between the housing and the cap, the cap is partially released and the gas flows through the inlet opening. The gas flows sufficiently near a plurality of electrode mounted to the housing and electrically connected to a high voltage power source. Ionization occurs and the ionized gas flows towards the workstation. The cap is fabricated from an elastic plastic material designed to deflect away from the housing allowing the pressurized gas to flow. The housing and cap are designed for facilitate gas flow through the inlet opening. The device is simple and inexpensive to manufacture.

6 Claims, 2 Drawing Sheets

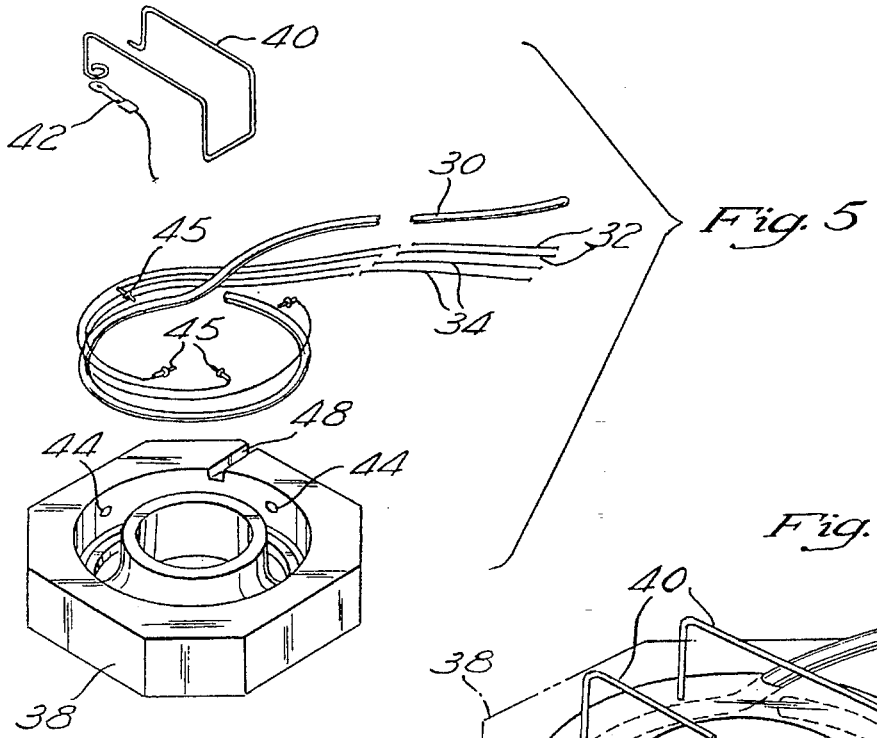
Fig. 5
Fig. 6
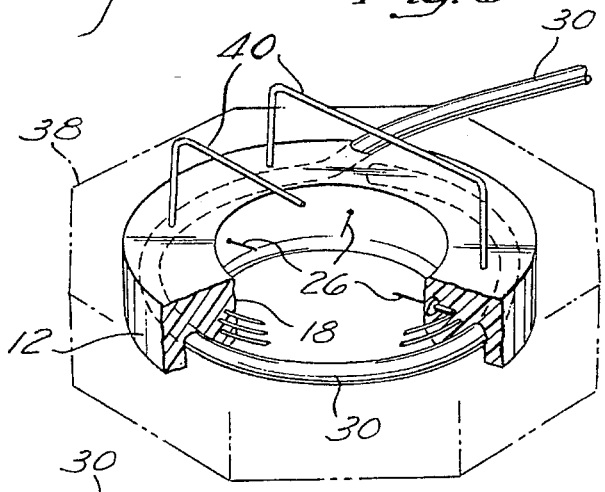
Fig. 7
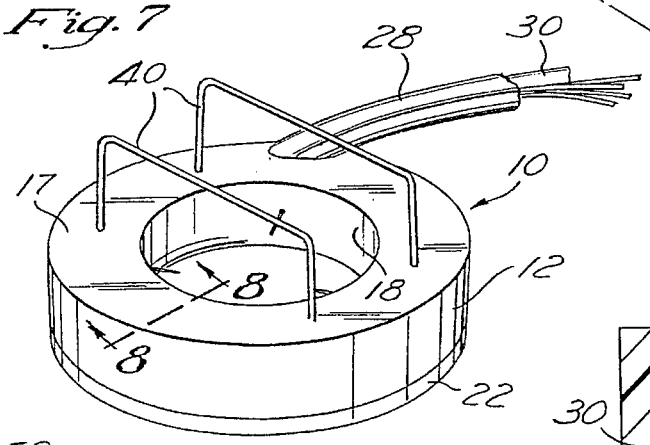
Fig. 8
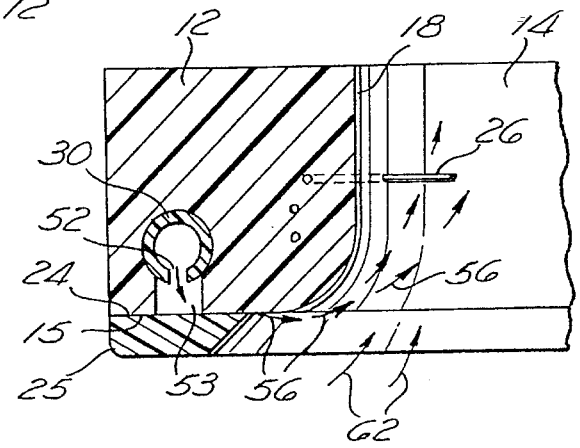
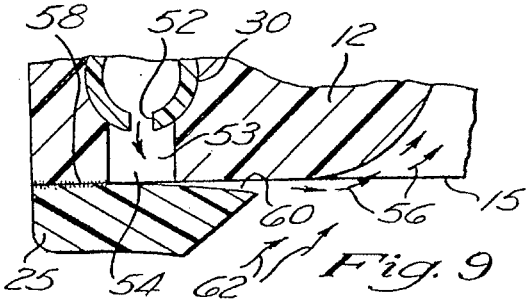
Fig. 9

AIR IONIZING RING

FIELD OF THE INVENTION

The present invention relates generally to devices which remove static charges from the air in the area of workstations, and more particularly to devices which produce an air flow of ions to neutralize static charges.

BACKGROUND OF THE INVENTION

The problems associated with statically charged air particles in the vicinity of sensitive manufacturing processes and sensitive work pieces are well known. The buildup of static charges on sensitive electronic components may lead to severe damage of those components. Defective electronic components may not be discovered until later part of a larger assembly that fails in the field, in which case often a much higher-dollar assembly must be repaired or returned.

Air ionizing apparatus are also not new. Partridge U.S. Pat. No. 5,055,963 (issued Oct. 8, 1991) describes air ionizing apparatus that produces a balanced number of positive and negative ions. It is important that the numbers of positive and negative ions produced are approximately equal, so as not to actually contribute to the problem of static discharge in the vicinity of the work piece. In Partridge, dispersal of the ions is accomplished by a fan that is housed in the device. The fan directs an airflow through the electrode region into the workstation.

Le Vantine U.S. Pat. No. 4,635,161 (issued Jan. 6, 1987) also describes an air ionizing device. Separate helical streams of positive and negative ions are mixed in a vortex chamber, and exit through small airjets. This device requires separate air supplies for the positive and negative electrodes, and a carefully designed chamber and nozzle to properly mix and disperse the ions.

The prior art further includes air ionizing rings fabricated of metal, that provide high pressure gas flowing through a small gap in the ring and then through the opening past the electrodes. These devices are expensive to manufacture, however, because they are comprised of precision machine parts to meet the tolerances of providing the small gap through which the gas flows. Some devices use shims to provide the small gap, but this adds extra parts and costs. Whether the small gap is machined in or built up with shims, the inner curved surfaces of the ring must be carefully machined to provide for a smooth flow of air through the ring.

Although such devices as described above have proven generally suitable for their intended purposes, they possess inherent deficiencies which detract from their overall effectiveness in the marketplace. Requiring a fan to be housed in an air ionizer leads to cost and complexity. Requiring two air supplies and a chamber and nozzle to mix and disperse ions is also needlessly complex. Requiring complex machined parts to make up an air ionizer is expensive.

SUMMARY OF THE INVENTION

In view of the shortcomings of the prior art it is the object of this invention to provide an air ionizing device that is both effective and inexpensive to manufacture due to its inherent simplicity. Although the prior art has recognized to a limited extent the problem of producing an effective yet simple and low cost solution to the problem of eliminating static charges in the vicinity of workstations to date, those efforts have been ineffective in providing a satisfactory remedy. The solutions to be proposed have heretofore never been addressed.

The present invention specifically addresses and alleviates the above-mentioned deficiencies associated with the prior art. Generally, the device of the present invention includes an annular shaped housing having an inner surface that forms an inlet opening. The device further includes a deformable ring-shaped cap that attaches to the housing on the inlet side. Mounted inside the housing opening are a plurality of electrodes connected to a high voltage power source. When high pressure gas is introduced between the cap and housing, it deflects the cap away and the gas follows along the inner surface of the housing opening past the electrodes. Positive and negative ions are created and dispersed through the ring towards the workbench or workstation. In addition, other outside air from the inlet side of the ring flows through the ring.

More particularly, the preferred embodiment of the device includes an annular-shaped housing fabricated from a polymer material, using a low-pressure molding process. The housing has a flat inlet side. The device further includes an annular-shaped cap also fabricated of a polymer material using low-pressure molding. The cap has a flat surface that corresponds to the flat side of the housing. The outboard portions of the housing and the cap are adhesively bonded together. A gas passageway is formed by a slot in the inlet side of the housing and by the gap between the housing and the cap. When high pressure gas is introduced into the passageway it lifts the inboard portion of the cap away, and the gas flows through the passageway past the electrodes and towards the workstation. The configuration of the cap is cut away at the inboard edge, i.e., the cap is thinner at the inboard edge. This is to facilitate the deflection of the cap and also to facilitate other outside air flowing through the housing. The preferred embodiment may further include a utilities passageway formed by a cavity in the housing. The utilities passageway allows the high pressure gas and electricity to be routed around the perimeter of the ring.

The advantages of the present invention are that it effectively projects an air stream of positively and negatively charged ions into a workstation, through use of a well engineered, but simple and inexpensive device. The material and dimensions of the cap are selected to provide the proper amount of deflection in creating the gas passageway, and to provide for additional outside air to be pulled through the ring. The housing and cap are producible through inexpensive manufacturing techniques, such as low pressure molding. There is no fan housed in the device. No dual supply of high pressure gas is required. No complex mixing chamber or nozzle is required. No expensive machine parts or shims are required.

Instead, the objective of suppressing static discharge in the workplace area is accomplished by exploiting aerodynamic and fluid flow principles. The high pressure gas flowing from the gap between the housing and the cap immediately adjoins the inner surface of the ring-shaped housing. Since the gas flow is within the boundary layer of that smooth surface, it adheres to that surface and flows around the constant-radius curve through the ring. The accelerated flow of gas also acts to pull outside air from the inlet side through the ring. The Venturi effect provides that as the gas velocity increases through the housing opening, the air pressure inside the opening drops, creating a vacuum to pull in outside air.

These, as well as other advantages of the present invention may be more apparent from the following description and drawings. It is understood that changes in the specific structure shown and described may be made within the scope of the claims without departing from the spirit of the invention.

BRIEF DESCRIPTION OF THE DRAWINGS

FIG. 5 is an exploded view of the parts of the air ionizing ring and the mold used to manufacture the preferred embodiment.

FIG. 6 is a perspective view of the parts of the air ionizing ring installed in the mold (shown in phantom lines).

FIG. 7 is an orientation view showing where the section cut for FIG. 8 is taken.

FIG. 8 is a cross-section view showing how the pressurized gas flows through the ring.

FIG. 9 is an enlarged view that shows the cap deflected away allowing the high pressure gas flow.

DETAILED DESCRIPTION OF THE PREFERRED EMBODIMENT

The detailed discussion set forth below in connection with the appended drawings is intended as a description of the presently preferred embodiment of the invention and is not intended to represent the only forms in which the present invention may be constructed or utilized. The description sets forth the functions and sequence of steps for constructing and operating the invention in accordance with the illustrated embodiment. It is to be understood, however, that the same or equivalent functions or sequences may be accomplished by different embodiments that are also intended to be encompassed within the spirit and scope of the invention.

Figure 1:
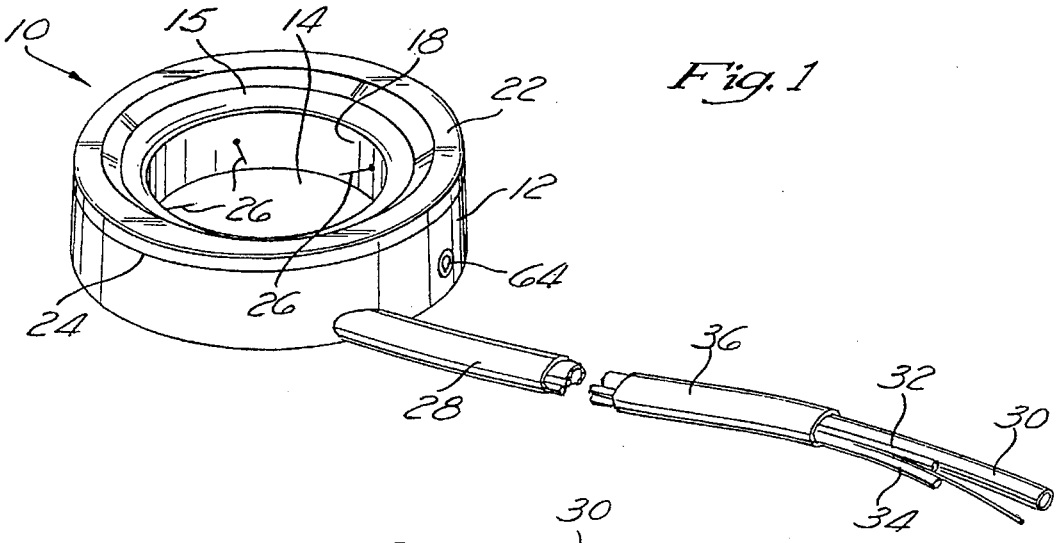
FIG. 1 is a perspective view illustrating an air ionizing ring in accordance with the present invention, showing the inlet side of the ring.
Figure 2:
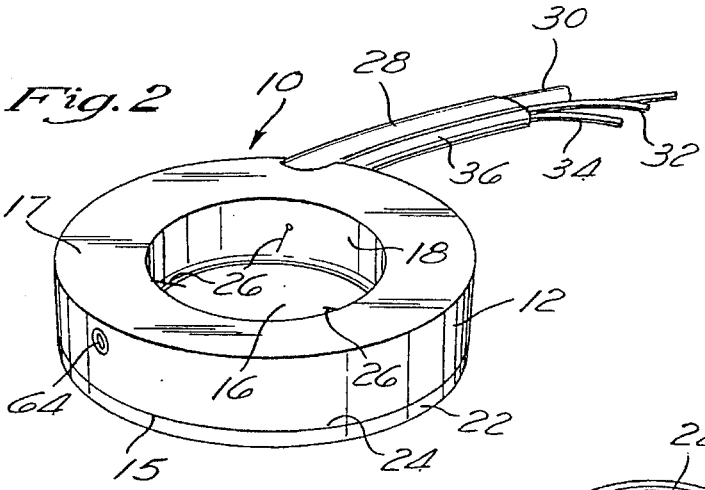
FIG. 2 is a perspective showing the outlet side.
Figure 3:
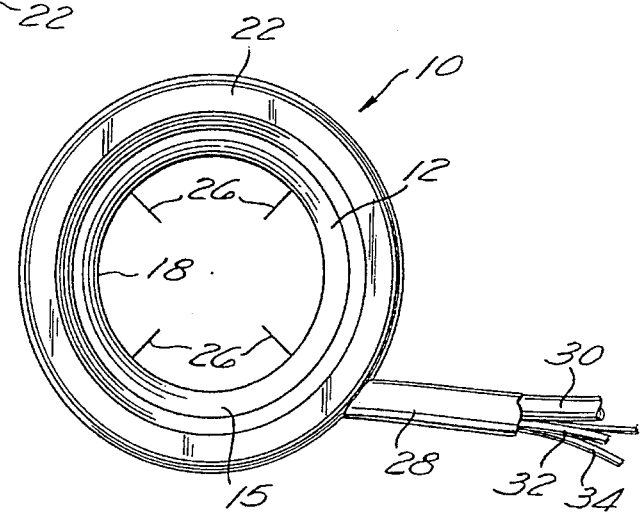
FIG. 3 is a plain view of the inlet side of the air ionizing ring.
Figure 4:
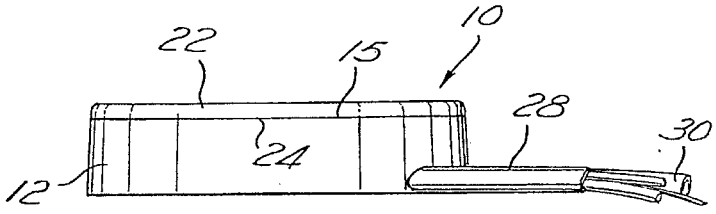
FIG. 4 is a side view of the air ionizing ring.

Referring to FIGS. 1–4, the structure of the air ionizing ring is comprised generally of a housing 12, having an inlet opening 14 in an inlet side 15, and an outlet opening 16 in an outlet side 17. The housing 12 has an inner surface 18, that runs from the inlet opening 14 to the outlet opening 16. The inlet side 15 is a relatively flat surface. The air ionizing ring 10 includes a cap 22, the cap 22 having an interface surface 24, which approximately corresponds to the flat surface of the inlet side 15 of the housing 12.

The air ionizing ring 10 includes several pairs of electrodes 26, small diameter wires that project inward approximately ½ inch from the inner surface 18 of the housing 12. The air ionizing ring 10 also includes a utilities bundle 28, which is comprised of gas line 30, a positive electrical wire 32, a negative electrical wire 34 and a protective sheath 36. The gas line 30 is connected to a conventional high pressure gas storage tank (not shown). Either air, nitrogen, or other non-toxic gas may be used. An appropriate flow rate may be in the range of ¼–20 cubic feet per minute. The electrical lines 32 and 34 are connected to opposing polarity terminals of a conventional high voltage power source (not shown). An appropriate charge of the electrodes 26 may be in the range of 3500–20,000 volts.

The electrodes 26 may be wired for self-balancing as disclosed in the prior art reference Partridge U.S. Pat. No. 5,055,963. Briefly, the positive volt-producing and negative volt producing sides of the circuit are electrically isolated from any ground. If the output of one charge changes relative to output of the opposite charge, the circuit re-equalizes itself by changing the output of the opposite charge.

Now referring to FIGS. 5 and 6, a low-pressure mold 38 may be used to manufacture the housing 12 of the preferred embodiment. The housing 12 is preferably fabricated from an insulative polymer material, and is preferably ring shaped though other shapes may also be feasible. The outside diameter of the housing 12 is approximately 3½ inches. The electrodes 26 and the gas line 30 and the electric wires 32 and 34 are installed into the mold 38. Pairs of positively charged and negatively charged electrodes 26 are spaced apart around the housing 12. Electrodes 26 of like charge should be located directly opposite each other in the housing 12. The mold also includes four tooling holes 44, which each accept a tooling pin 45, and are used to position the electrodes 26 in the mold 38. The tooling pins 45 are removed from the housing 12 after the molding operation. Optionally, there may be a slot 48 in the mold 38 for positioning the gas line 30 and electric wires 32 and 34 to exist tangentially from the housing 12. Alternatively, the air lone 30 and electric wires 32 and 34 may exit the housing 12 perpendicular to the outlet side 17 (not shown). In addition, the preferred embodiment includes a guard 40 and a grounding strap 42 for the guard 40. The air ionizing ring 10 of the present invention may also include a conventional stand (not shown) that holds the housing 12 at a pair of screw holes 64, in such an orientation that the outlet opening 16 of the housing 12 is directed towards a workstation.

Now referring to FIGS. 7–9, the details of the air flows through the air device will be discussed. The outboard portion 25 of the interface surface 24 of the cap 22 is bonded to the outboard portion of the flat inlet side 15 of the housing 12, with an adhesive 58. The portion of the gas line 30 that is routed around the housing 12 has a slit 52, that allows high pressure gas to escape into a slot 53 in the housing 12. A gas passageway 54 is formed when the high pressure gas lifts up the inboard edge 60 of the cap 22 away from the inlet side 14 of the housing 12. This allows an accelerated gas flow 56 between the cap 22 and the housing 12, following the inner surface 18 of the housing 12 past the electrodes 26. The accelerated gas flow 56 acts to pull other outside air 62 through the inlet opening 14 of the housing 12.

The design of the slits 52 in the gas line 30, the slot 53 in the housing 12 and the inboard edge 60 of the cap 22 are important to provide an appropriate gas passageway 54 and gas flow 56. The slot 53 is designed to provide a uniformly distributed load onto the interface surface 24 of the cap 22. This load acts to induce bending into the cap 12, since the outboard portion 25 of the cap 22 is bonded by an adhesively 58 to the housing 12. The distance from the adhesive 58 to the inboard edge 60 creates a lever arm. The thickness of the cap 12 defines the cross-section of a beam. The modulas of elasticity of the cap material may be used to calculate theoretical values for the bending stress that will be introduced into the cap 12, and the strain and deflection that will result at the inboard edge 60. The calculations may be verified by testing various cap 12 materials and inboard edge 60 designs. Measurements may be taken of the width of the gas passageway 54 between the housing 12 and the cap 22, and of the rate of gas flow 56. If necessary, adjustments may be made, e.g., adjusting the gas pressure, changing the thickness or material of the cap 12, etc.

It is understood that the exemplary air ionizing ring 10 described herein and shown in the drawings represents only a presently preferred embodiment of the invention. Indeed, various modifications and additions may be made to the preferred embodiment without departing from the spirit and scope of the invention. Thus, these and other modifications and additions may be obvious to those skilled in the art and may be implemented to adapt the present invention for use in a variety of different applications.

What is claimed is:

1. An air ionizing ring comprising:

a) a housing having an inlet side with an inlet opening, and a spaced apart outlet side with an outlet opening, the housing further having an inner surface from the perimeter of the inlet opening to the perimeter of the outlet opening;

b) a cap having a portion releaseably connected to the inlet side of the housing;

c) a gas passageway proximate the housing and connectable to a pressurized gas supply, said gas passageway configured to deliver pressurized gas from the pressurized gas supply to between the housing inlet side and the cap;

d) wherein the cap releasable portion is configured to move away from the housing inlet side upon delivery of pressurized gas to the gas passageway, such that the gas flows between the housing inlet side and the cap and through the housing inlet opening; and e) a plurality of ionizing electrodes spaced apart each having one end mounted to the housing inner surface, the electrodes electrically connectable to a high voltage power supply.

2. The air ionizing ring of claim 1, wherein the cap has opening, allowing room air to flow through the cap opening and housing inlet opening.

3. An air ionizing ring comprising:

a) an annular-shaped housing having an inlet side and an outlet side, and an inner surface that forms a circular opening through the housing from the inlet side to the outlet side, the housing opening from the inlet side having a decreasing diameter such that the inner surface follows a curve from the inlet side;

b) an annular-shaped cap having a circular opening, and an inner surface that approximately corresponds to the inlet side of the housing, with an outboard portion of the inner surface adhesively bonded to an outer portion of the housing inlet side;

c) a gas passageway formed by a slot in the housing, said gas passageway connectable to a pressurized gas supply;

d) wherein the cap inboard portion is configured to deflect away from the housing upon delivery of pressurized gas to the gas passageway, such that gas flows between the housing inlet side and the cap inner face surface and through the housing opening; and e) a plurality of ionizing electrodes spaced apart each having one end mounted to the housing inner surface, the electrodes electrically connectable to a high voltage power supply.

4. The air ionizing ring of claim 3, wherein the cap is fabricated of insulative polymer material.

5. The air ionizing ring of claim 3, wherein the cap has a decreased thickness near the cap opening, to facilitate deflection of the inboard portion of the cap away from the housing upon delivery of the pressurized gas to the gas passageway.

6. The air ionizing ring of claim 3, wherein the gas passageway extends substantially through the housing, for providing capability for gas flow around a substantial portion of the housing opening.

* * * * *